US005131104A

United States Patent [19]

Larson

[11] Patent Number: 5,131,104

[45] Date of Patent: Jul. 21, 1992

[54] WATER BED COVERING CORNER SECUREMENT SYSTEM

[76] Inventor: Lynn D. Larson, 1052 N. Lakeshore Dr., Lincoln, Nebr. 68528

[21] Appl. No.: 767,645

[22] Filed: Sep. 30, 1991

[51] Int. Cl.[5] ..... A47C 21/02

[52] U.S. Cl. ..... 5/504.1; 24/72.5

[58] Field of Search ..... 5/504, 508, 496, 498, 5/451, 450, 452; 24/72.5

[56] References Cited

U.S. PATENT DOCUMENTS

| | | | |
|---|---|---|---|
| 3,092,848 | 6/1963 | Gronvold | 5/498 |
| 4,276,667 | 7/1981 | Osbourne | 5/498 |
| 4,539,723 | 9/1985 | Hillsberry | 5/504 |
| 4,660,240 | 4/1987 | Hutton et al. | 5/451 |
| 4,769,865 | 9/1988 | Delaino | 5/504 |
| 4,773,108 | 9/1988 | Leever | 5/504 |
| 4,782,543 | 11/1988 | Hutton et al. | 5/498 |
| 4,833,745 | 5/1989 | Delaino | 5/504 |

*Primary Examiner*—Alexander Grosz
*Attorney, Agent, or Firm*—John A. Beehner

[57] ABSTRACT

A bed covering corner securement system consisting of a three sided corner apparatus having an inner and outer surface, a generally horizontal semirigid base and two upright semirigid sides. The sides and base form a corner section of a cube for receiving a corner of a waterbed mattress. A bed covering retention device is mounted on the inner surface of the corner apparatus. Suitable bed covering retention devices include either one or more bed covering securing slots or a frictional securement device. The system is used by placing the corner apparatus underneath a corner of the waterbed mattress where the weight of the mattress presses down on the base of the apparatus to secure it in place. Bed coverings are then secured by engagement with the bed covering retention device.

7 Claims, 4 Drawing Sheets

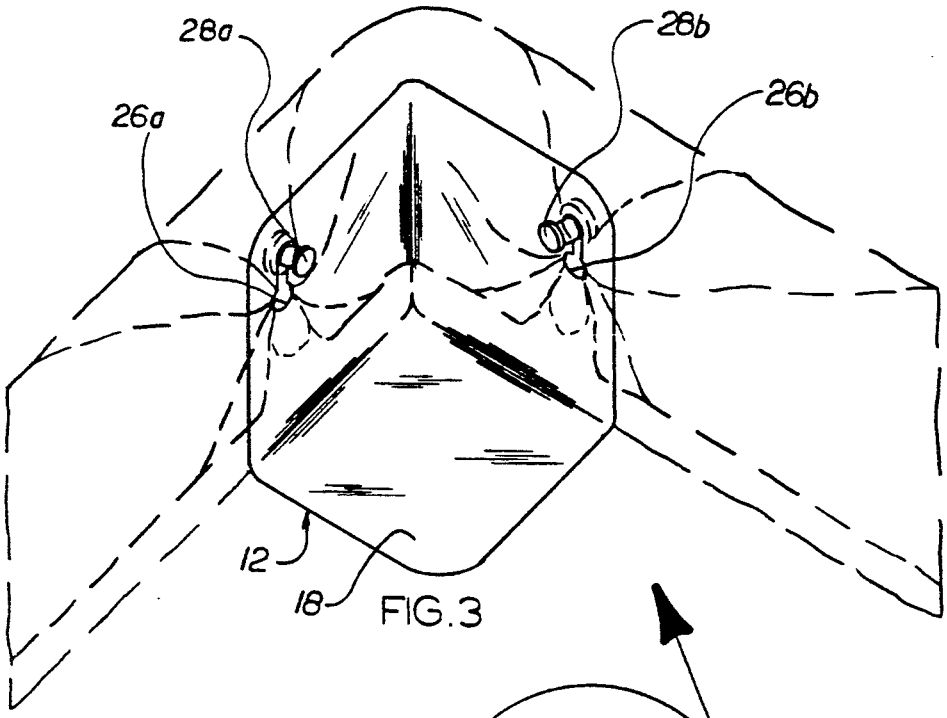
FIG. 3
FIG. 3A
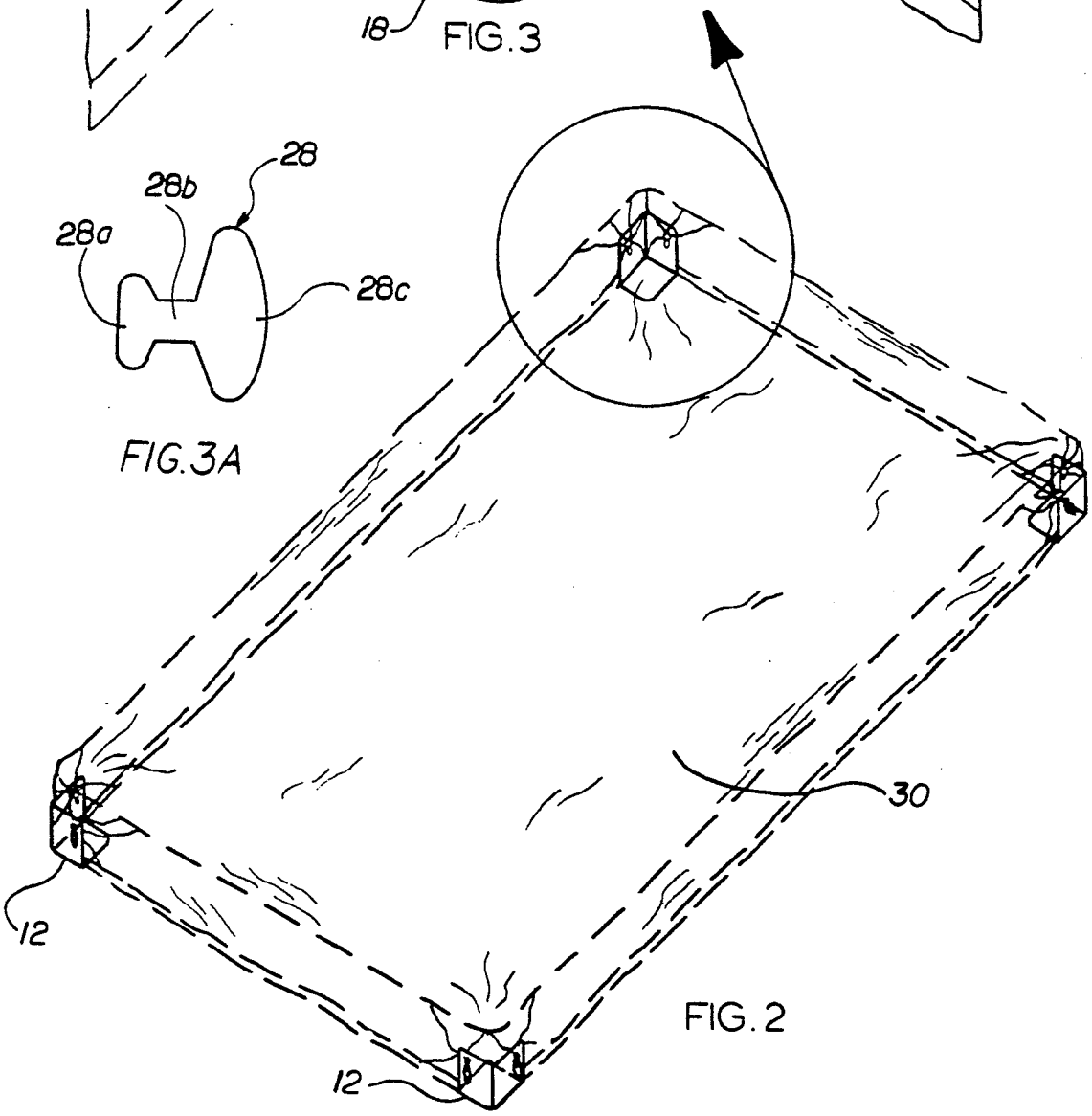
FIG. 2

WATER BED COVERING CORNER SECUREMENT SYSTEM

BACKGROUND OF THE INVENTION

1. Field of the Invention

The present invention is directed generally to an apparatus for securing bed coverings onto a waterbed mattress and more particularly to a generally three sided corner section adapted to receive a corner of a waterbed mattress and engage the bed coverings on the mattress to resist removal of the bed coverings from the mattress.

2. Description of the Prior Art

Unintentional dislodgment of the bed coverings is a problem associated with many commercially available waterbed mattresses. Due to the unique fluid motion within the waterbed, bed coverings relying on "cupping" action, such as fitted sheets, may become dislodged. Various forms of securement devices have been suggested, all of which have their drawbacks. For example, two U.S. patents, Luchonok U.S. Pat. No. 5,005,237, and Johenning U.S. Pat. No. 4,930,172, describe frictional securing devices for bed coverings. However, both devices must be mounted on the waterbed mattress itself, with the Johenning device being a molded corner cap requiring installation during construction of the mattress. The Luchonok device is a frictional patch secured onto the corner of a waterbed mattress. Both devices become permanent components of the waterbed mattress on which they are installed. Furthermore, both devices are wholly dependent upon some external structure such as a bed frame for urging bed coverings into frictional engagement with the exterior surface of the respective corner patch. Thus neither of these devices present optimal solutions to the problem posed.

Other securement devices have been suggested, such as McLeod, U.S. Pat. No. 4,301,561, which discloses a sheet and liner combination for use on a waterbed. McLeod, however, requires specially designed sheets and liners, which results in increased costs for the waterbed owner.

Another securement device is disclosed by Hutton, U.S. Pat. No. Des. 288,162. Hutton discloses a stud for use with a slotted fastener attached to a strap for securing bed clothing. The strapped fasteners however are not self supporting and require generally permanent securement to the waterbed support structure. Moreover, the slot and stud securement means as described in the Hutton patent is unable to accommodate any or all types of bed clothing.

Accordingly, an object of the present invention is to provide an improved bed covering corner securement apparatus.

Another object of the present invention is to provide a bed covering corner securement apparatus which is usable with virtually all commercially available or presently owned waterbed mattresses.

Still another object of the present invention is to provide a bed covering corner securement apparatus which is used with but is not an integral part of the waterbed mattress, so that it may be used with and added to even presently owned mattresses.

Still yet another object of the present invention is to provide a bed covering corner securement apparatus which secures bed coverings by a bed covering securement slot in a fitted three sided corner apparatus.

Finally, an object of the present invention is to provide a bed covering securement apparatus which is safe to use, durable in construction, and economical to manufacture.

Other purposes will become clear through disclosure in the following specification, drawings, and claims.

SUMMARY

The bed covering corner securement system of the invention is directed to an improved securement system having a bed covering retention means mounted on a substantially cubic corner section for retaining bed coverings by the retention means.

A waterbed mattress is usually held in a liner, which in turn is supported by a frame having four sidewalls and a base. Waterbeds and frames are generally rectangular. Depending on what types of liner and mattress and frame are being used, the bed coverings are either pressed into the slot formed between the liner and frame sidewall, or in the slot between the mattress and the liner. The present invention is designed to accommodate either type of waterbed and to secure the bed coverings thereon.

The corner apparatus is a substantially cubical corner section in shape, having a base and two sides to which a bed covering retention means is mounted. The shape of the corner apparatus roughly corresponds to the shape of a corner of the waterbed mattress, such that a corner of the mattress will fit within and substantially fill the corner apparatus.

In one embodiment, the bed covering retention means consists of at least one keyhole-shaped slot in the corner apparatus and a coacting stud fastener. These are designed to secure bed clothing, and operate by the bed clothing being passed through the slot and secured by the stud therein.

In an alternative embodiment, the bed covering retention means consists of a frictional securement means mounted on an upright sidewall of the corner section. The frictional securement means is preferably an inverted T-shaped piece of a synthetic rubber-like compound which is mounted on the corner apparatus such that the T-leg is centered the connection line between the two sides and the top edge of the T-cross section is adjacent to the base of the corner apparatus.

The frictional securement section has a greater coefficient of friction between it and the bed coverings than that between the bed coverings and the mattress thereby to releasably grip the bed coverings. Accordingly, a greater force is required to withdraw bed coverings releasably retained by the corner apparatus of the present invention.

The corner apparatus is held in position by being placed in the corner of the frame and having the weight of the mattress on the base of the corner apparatus.

An alternative embodiment would form the corner apparatus from a single rectangular sheet having a slot, which, when folded in a specific manner, would result in the previously described corner apparatus shape being formed.

BRIEF DESCRIPTION OF THE DRAWINGS

FIG. 2 is a perspective view of a waterbed mattress with four bed covering corner securement apparatus in place with the bed coverings secured therein.

FIG. 3 is an expanded perspective view of one bed covering corner securement apparatus in place on a waterbed mattress securing bed coverings.

FIG. 3A is a side view of the bed covering securement stud.

DESCRIPTION OF THE PREFERRED EMBODIMENT

Figure 1:
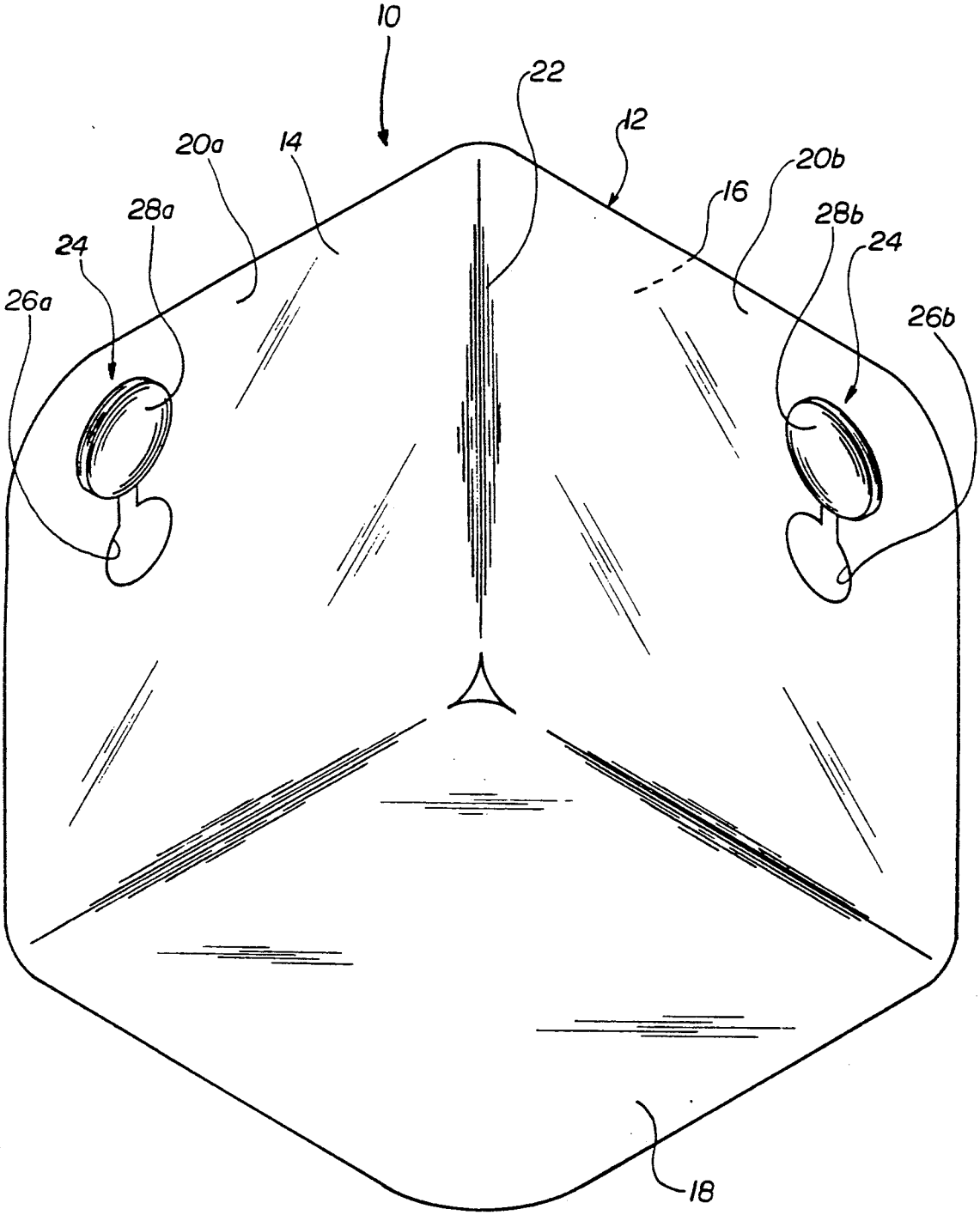
FIG. 1 is a perspective view of the present invention showing the cubic corner shape of the invention and the bed covering holding slots.

The bed covering corner securement system 10 of the present invention is shown in one preferred embodiment in FIG. 1 as including a corner apparatus 12 having inner and outer surfaces 14 and 16, a semirigid rectangular base 18 and two semirigid upright rectangular sides 20*a* and 20*b*. In the preferred embodiment, the two sides 20*a* and 20*b* are connected to each other in substantially perpendicular but rounded relation, thus forming a corner 22. The two sides 20*a* and 20*b* are connected along their lower edges to two adjacent edges of the base 18, such that a corner section of a cube is formed, one which will receive the corner of a waterbed mattress therein.

The preferred construction material for the corner apparatus 12 is a heavy guage plastic sheeting which is semirigid. The corners of the corner apparatus 12 are preferably curved to avoid accidental puncturing of the waterbed mattress. These two features combine to afford safer usage of the present invention.

The bed covering retention means 24 in the embodiment of FIG. 1 includes a pair of bed covering securing slots 26, shown in the figures 26*a* and fastening studs 28. The slots 26 and are preferably keyhole-shaped with a generally circular wide section and an upwardly extending narrower slot section. The slots are cut into and through the upright sides 20*a* and 20*b*, preferably one in each side, such that a section of bed covering may be drawn into and through each slot 26. The sections of bed coverings are held in the respective slots 26 by the fastening studs 28. A preferred embodiment of a fastening stud 28 includes a base portion 28*a*, a neck portion 28*b*, and a head portion 28*c*. The neck portion 28*b* extends between and is connected to the head and base portions 28*c* and 28*a*, and is narrow enough to slide into the narrow slot sections of the bed covering securing slots. Neither the head nor base portions are narrow enough to pass through the narrow slot sections, however, the base portion of the stud 28 is narrow enough to pass through the circular wide section. The head portion is too wide to pass through the slot, and therefore, when the stud 28 is in place in a slot 26, the head and base portions are adjacent opposite surfaces 14 and 16 of the corner apparatus 12, with the neck portion extending through the slot 26. In the preferred embodiment, the fastening studs 28 are constructed of a synthetic rubber-like compound with a high resiliency and large coefficient of friction.

the bed coverings are engaged in the slots 26, as shown in FIGS. 2 and 3, by being first wrapped around the base portion 28*a* of a stud 28 whereupon the wrapped base is inserted through the circular wide section of a slot 26 and then moved upwardly into the narrow slot sections to securely retain the bed coverings against accidental withdrawal.

FIGS. 2 and 3 also show the means by which the corner apparatus 12 are held in position. The mattress corner can be lifted and the corner apparatus 12 placed with the base 18 adjacent the underside of the mattress 30 and the inner surface 14 facing the mattress 30. The mattress corner can then be lowered, with the mattress substantially conforming to and filling the corner apparatus 12, which is secured in place both by the weight of the mattress 30 and the friction between the mattress 30 and the base 18 of the corner apparatus 12.

Figure 6:
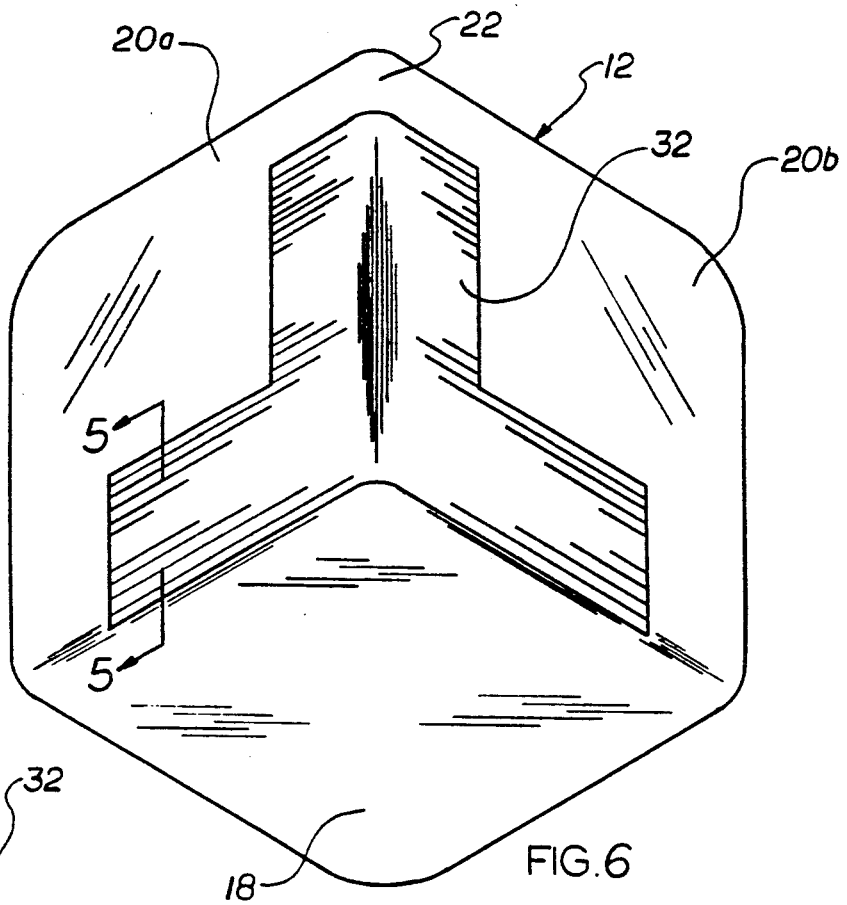
FIG. 6 is a perspective view of the present invention showing the frictional securement means being held on the corner apparatus by glue or other such attachment means.
Figure 5:
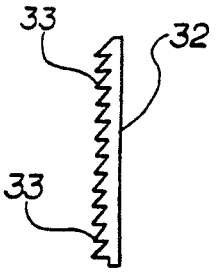
FIG. 5 is a transverse sectional view through the frictional securement strip, taken along line 5—5 in FIG. 6.
Figure 4:
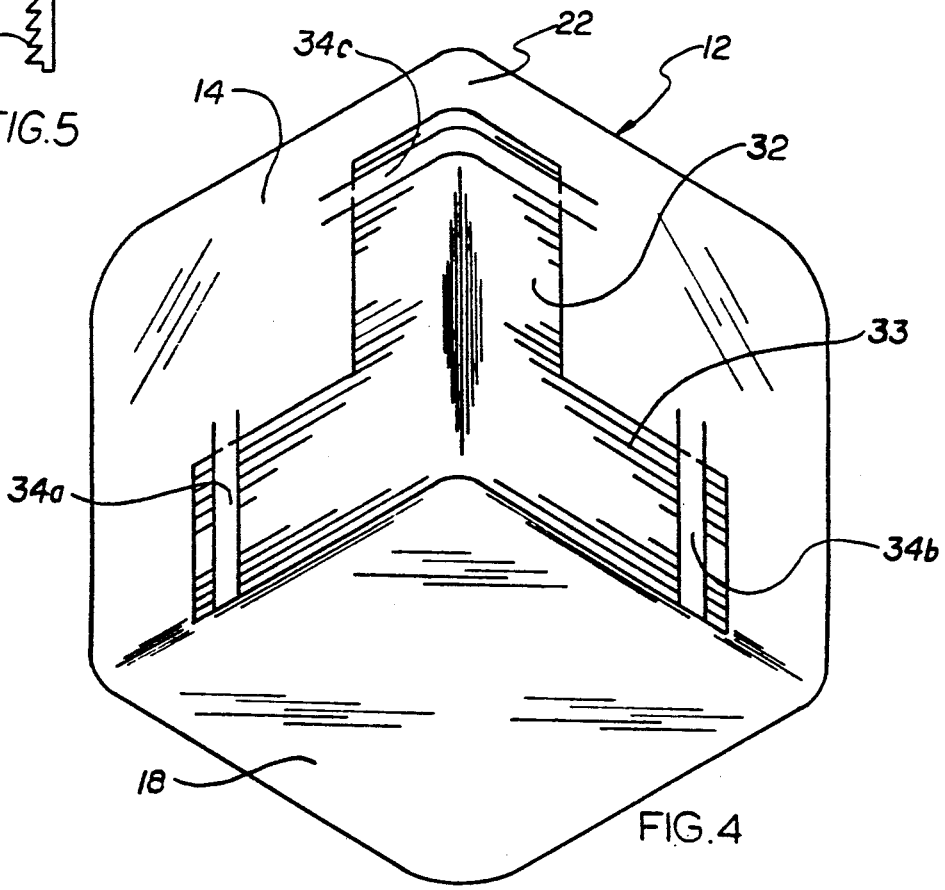
FIG. 4 is a perspective view of the present invention showing the frictional securement means being held on the corner apparatus by slots placed in the sides of the corner apparatus.

An alternative bed covering retention means is shown in FIGS. 4 and 6. It is a frictional securement device 32, preferably in an inverted T-shape, mounted on the inner surface 14 of the corner apparatus 12. The frictional securement device 32 is preferably constructed of a piece of synthetic rubber-like compound in sheet form, having raised ridges 33 on its exposed surface as shown in FIG. 5. The raised ridges 33 preferably run substantially parallel to the base 18 of the corner apparatus 12 when the frictional securement device 32 is in place.

The frictional securement device 32 can be mounted on the inner surface 14 in various ways, two preferred ways being shown in FIGS. 4 and 6. FIG. 4 shows the frictional securement device 32 secured on the corner apparatus 12 by a set of holding slots 34 *a–c*. Each holding slot 34 *a–c* is preferably constructed by cutting two parallel slits in the corner apparatus 12, the slits approximately ½" apart and slightly longer than the width of the section of the frictional securement device 32 to be placed therethrough. The two lower holding slots 34*a* and 34*b* are substantially vertical to accommodate opposite ends of the T-cross, and are cut one into each side 20*a* and 20*b*. The upper holding slot 34*c* is substantially horizontal and preferably centered on the corner 22 to accommodate the T-leg of the frictional securement device 32.

FIG. 6 shows the frictional securement device 32 mounted on the corner apparatus 12 by glue. Other suitable securement means may be substituted for the slots 34 or glue.

The frictional securement embodiments of FIGS. 4 and 6 are placed and held in position in the same way as previously described and shown in FIGS. 2 and 3 in connection with the previous embodiment.

Bed coverings are secured in the following way. The mattress 30 and frictional securement device 32 are separated enough to place the bed coverings therebetween. When the mattress 30 and frictional securement device 32 move back closer together, due to force exerted by the mattress 30 on the base 18 and the resiliency of the semirigid plastic of the corner apparatus 12, the bed coverings are gripped between the mattress 30 and frictional securement device 32. The water pressure urging the mattress 30 against the frictional securement device 32 increases the frictional hold on the bed coverings.

Figure 8:
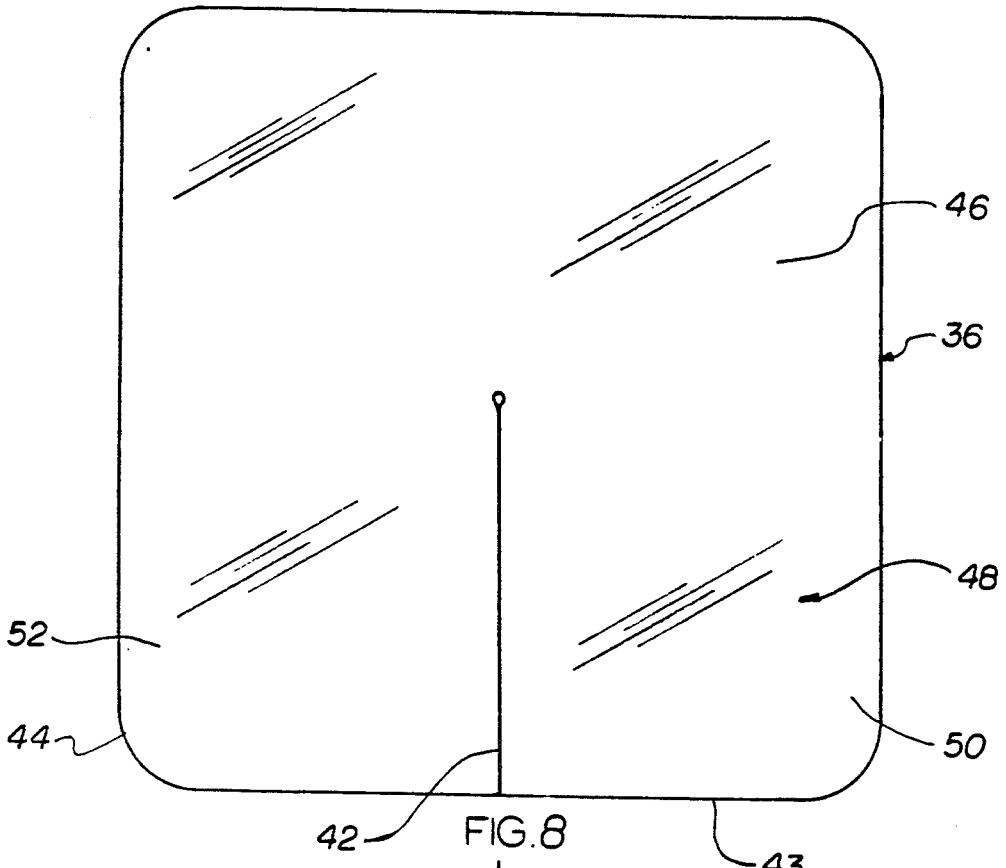
FIG. 8 is a top plan view of the corner section of FIG. 7 before folding, in a preferred storage mode.
Figure 7:
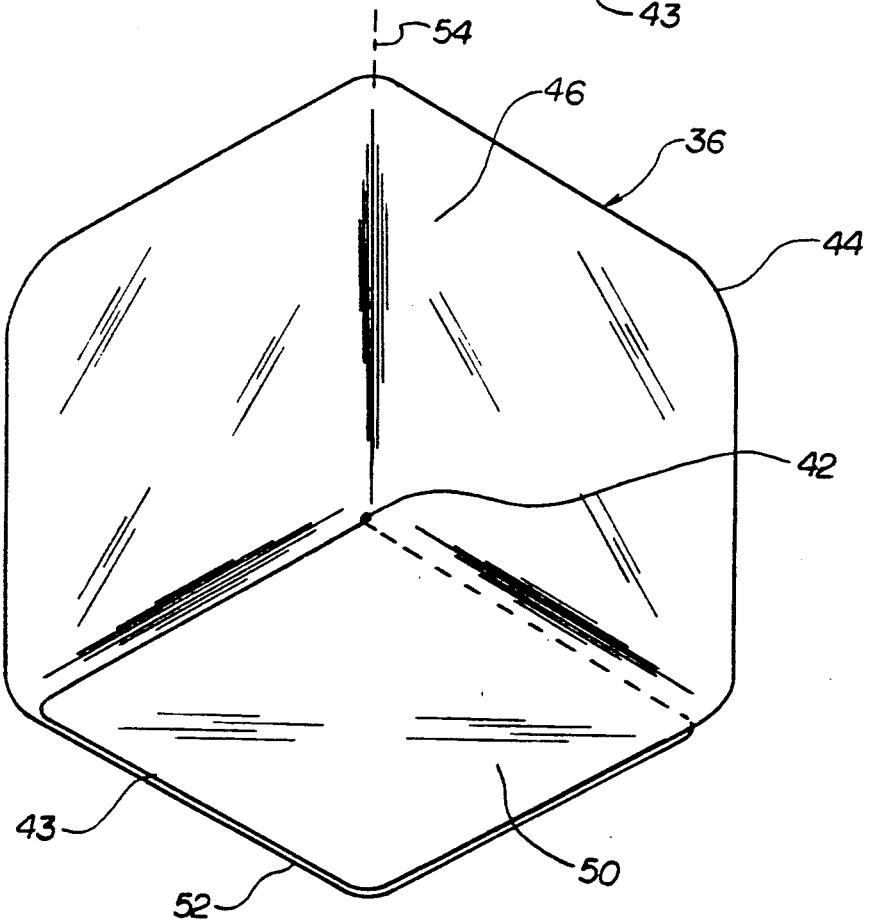
FIG. 7 is a perspective view of an alternative embodiment of the present invention having a slotted base forming overlapping flaps.

An alternative embodiment of the corner apparatus 40 is shown in FIGS. 8 and 7. This embodiment is furnished as a substantially rectangular semirigid flat blank 36 having a slot 42 extending inwardly from a medical position along one side edge 43.

The slot 42 is preferably centered relative to side 43 of a generally square blank 36 having rounded corners 44. The slot is directed substantially perpendicular to the side 43 to approximately the center of the blank, thereby defining an unslotted upper portion 46 and a slotted lower portion 48 including right and left bottom flaps 50 and 52. The upper portion 46 of the corner apparatus is foldable along a line 54 substantially aligned with slot 42. The right and left bottom flaps are then foldable inwardly substantially perpendicular to the upper portion into overlapped relation to define a folded corner section 40 of a generally cubic shape. The height of the sidewalls of upper portion 46 is less than or equal to the height of the support surface of a frame or the like which it engages so as to be of a size and shape to receive and be substantially filled by a corner of a waterbed mattress. One embodiment of the corner apparatus 40 is formed as a substantially square blank of approximately 13" by 13".

The alternative embodiment of FIGS. 7 and 8 is provided with bed covering retention means such as the securing slots 26 shown in FIGS. 1–3, 3A, or the frictional securement means 32, shown in FIGS. 4–6.

Whereas the invention has been described and shown with a certain degree of particularity, it is to be understood that many modifications, substitutions and additions may be made which are within the intended broad scope of the appened claims.

Thus there has been described and shown a bed covering corner securement system which accomplishes at least all of the stated objects.

I claim:

1. A bed covering corner securement system comprising, a corner apparatus having an inner and outer surface, comprising a substantially rectangular semirigid generally flat sheet having a slot, extending inwardly from a medial position along one side, substantially perpendicular to said side, thereby defining an upper portion and a slotted lower portion including right and left bottom flaps, the upper portion of said corner apparatus being foldable along a line substantially aligned with said slot and said right and left bottom flaps being foldable inwardly substantially perpendicular to said upper portion in overlapped relation to define a folded corner section of a generally cubic shape, said folded corner section being of a size and shape to receive and be substantially filled by a corner of a waterbed mattress, and a bed covering retention means on said corner apparatus, said bed covering retention means being operative to engage and resist removal of bed coverings from a waterbed mattress received in said folded corner section.

2. The bed covering corner securement system of claim 1 wherein said bed covering retention means comprises one or more bed covering securing slots, whereby said bed coverings may be extended through said slot and held therein.

3. The bed covering corner securement system of claim 2 wherein said bed covering securing slots are keyhole shaped, having a narrow section and a wide section, and further comprising a fastening stud having a base portion, a neck portion, and a head portion, said neck portion connecting said base and head portions, said head and base poritons each being too large to pass through said narrow section of said keyhole shaped slots, said neck portion being of a width to pass through said narrow section of said slot said base portion being of width to pass through said wide section of said slot.

4. The bed covering corner securement system of claim 1 wherein said bed covering retention means comprises a frictional securement means mounted on said inner surface of said corner apparatus whereby bed coverings placed between said frictional securement means and a waterbed mattress and releasably held therebetween.

5. The bed covering corner securement system of claim 4 wherein said frictional securement means is mounted on the fold line of said upper portion and is adapted to substantially conform to and contact a waterbed mattress, received in said folded corner section whereby bed coverings placed between said frictional securement means and sad waterbed mattress are held therebetween by frictional securement.

6. The bed covering corner securement system of claim 5 wherein said frictional securement means comprises a strip of synthetic rubber-like compound.

7. The bed covering corner securement system of claim 1 wherein said corner apparatus comprises semirigid plastic sheeting.

* * * * *